United States Patent [19]

Adams

[11] Patent Number: 4,561,361

[45] Date of Patent: Dec. 31, 1985

[54] MOUNTING FOR THE TOP CHORDS OF THE SIDES OF A RAILROAD HOPPER CAR

[75] Inventor: Norman S. Adams, Cincinnati, Ohio

[73] Assignee: Ortner Freight Car Company, Milford, Ohio

[21] Appl. No.: 588,370

[22] Filed: Mar. 12, 1984

[51] Int. Cl.[4] ..... B61D 17/00

[52] U.S. Cl. ..... 105/406 R; 105/248; 105/409; 105/411

[58] Field of Search ..... 105/404, 406 R, 409, 105/411, 247, 248

[56] References Cited

U.S. PATENT DOCUMENTS

| | | | |
|---|---|---|---|
| 907,410 | 12/1908 | Sage | 105/406 R |
| 2,361,276 | 10/1944 | Duffie | 105/409 |
| 2,402,267 | 6/1946 | Wine | 105/409 |
| 3,833,135 | 9/1974 | Larsen | 105/409 |

*Primary Examiner*—William E. Wayner
*Attorney, Agent, or Firm*—Frost & Jacobs

[57] ABSTRACT

Top side chord attachment for the sides of bottom-discharge, open-top railroad hopper cars of the type with which top shakers may be used. Each car side comprises a vertically oriented side sheet, affixed at its bottom edge to a bottom chord in the form of the car frame side sill and affixed at its top edge to a top chord. A plurality of side posts having lateral flanges are arranged vertically along the car side exterior in parallel spaced relationship. Each side post is affixed to the bottom chord, to the top chord, and along its lateral flanges to the side sheet. The top chord comprises a beam-like member extending substantially the length of the side sheet and having a horizontal portion terminating at its longitudinal in-board edge in a downwardly depending leg lying along the inside surface of the upper edge of the side sheet. A pair of gussets are located to either side of the upper end of each side post, overlying the side post flanges and the adjacent portions of the side sheet. The gussets have upper edges in abutment with the horizontal portion of the top chord. The gussets enable fastening means passing therethrough and through the side post flanges, the side sheet and the in-board leg of the top chord to be in double shear for additional strength and rigidity of said top chord attachment.

22 Claims, 6 Drawing Figures

MOUNTING FOR THE TOP CHORDS OF THE SIDES OF A RAILROAD HOPPER CAR

TECHNICAL FIELD

The invention relates to an improved mounting for the top chords of the sides of a railroad hopper car, and more particularly to such construction utilizing gussets, enabling selected ones of the fastening means for the top chords to be in double shear for additional strength and rigidity of the top chords.

BACKGROUND ART

Prior art workers have devised many types and sizes of open-top, bottom-discharging railroad cars, generically termed hopper cars. Such cars have been designed for many types of lading, including (but not limted to) coal, aggregate, wood chips and the like.

Such cars, when loaded, are brought to unloading stations where their bottom hopper doors are opened. The lading is discharged through appropriate openings between the railroad rails to bins, conveyors, or the like located beneath the railroad rails. The hopper doors may extend transversely of the longitudinal center sill of the car, or they may extend parallel to the center sill. The hopper doors may be opened manually or through the agency of mechanical door opening devices, depending upon the design of the car.

In many instances, the lading is not easily discharged. Normal, over-the-road shifting and vibration of the car tends to compact the lading therein. Frequently, the lading gets wet and/or frozen. As a result, it is not unusual to provide one or more mechanical car shakers to operate on the hopper car during the lading discharge operation, to assist and speed up the discharge opera- tion.

Many types of car shakers have been developed. Shakers most frequently used with open-top, bottom-discharge hopper cars comprise frame-like members which extend transversely of the hopper car, spanning the hopper car and engaging the upper horizontal surfaces of the top chords of the hopper car sides. The shaker has a pair of downwardly depending stop members located near each top chord and capable of abutting the in-board surface of the adjacent car side top chord to prevent the shaker from "walking" off the car side top chords in a direction transverse the hopper car. The shaker generally employs a weighted eccentric which is rotated by an appropriate prime mover. The rotating eccentric imparts violent shaking to the shaker, which in turn is imparted to the car by virtue of the shaker's contact with the top chords of the car sides. In some unloading facilities, more than one shaker is applied to a given hopper car. In some instances, one or more shakers are indexed along the hopper car. In other instances, the hopper car, itself, is indexed with respect to one or more shakers.

The forces imparted to the hopper car by a shaker are primarily vertically oriented forces. As will be explained hereinafter, means are provided to confine these forces as near to the plane of the side sheets as is possible. Nevertheless, a shaker imparts to the car sides and their top chords vertical forces far in excess of those normally experienced in over-the-road travel and the like. Therefore, it is of utmost importance that the attachment of the top chords to their respective sides of the hopper car be sufficiently strong and rigid to prevent failure of this attachment and consequent damage to the related parts due to the action of one or more car shakers. The present invention is applicable to any hopper car of the type wherein the top chords are joined to their respective hopper car sides with fastening means. The fastening means can be of any form. As a non-limiting example, the fastening means can comprise rivets, two-piece rivets, bolts or the like. While the teachings of the present invention are clearly applicable to hopper cars of all steel construction, in recent years considerable interest has been directed to aluminum-steel hopper cars wherein the car underframe is made of steel and substantially the entire body supported thereby is made of aluminum. Such cars provide a considerable weight savings. The teachings of the present invention are particularly applicable to such cars.

DISCLOSURE OF THE INVENTION

According to the invention, there is provided a top chord attachment construction for the sides of bottom-discharge, open-top railroad hopper cars to better withstand the extremes of the vertical loads applied to the top chords of the car sides by car top shakers. Each car side comprises a vertically oriented side sheet, extending longitudinally of the car, and affixed at its bottom longitudinal edge to a bottom chord in the form of the car frame side sill and affixed at its top longitudinal edge to a top chord in the form of a bulb angle, an angle iron, or the like. A plurality of side posts, having lateral flanges along their length, are arranged vertically along the car side exterior, in parallel spaced relationship. Each side post is affixed at its lower end to the bottom chord, at its upper end to the top chord, and along its length to the side sheet of the hopper car.

A bulb angle top chord comprises a beam-like member extending substantially the length of the side sheet and having a horizontal portion terminating at its outboard longitudinal edge in a downwardly depending bulb-like leg which may abut the upper ends of the side posts, or which may be spaced upwardly therefrom. The bulb angle top chord terminates at its longitudinal in-board edge in downwardly depending leg. This last mentioned leg lies along the inside surface of the upper edge of the side sheet. An angle iron top chord is similar to the above described bulb angle top chord with the exception that there is no bulb-like downwardly depending leg at the out-board longitudinal edge of its horizontal portion.

A pair of gussets are provided for each side post and are applied to either side of the upper end of each side post. Each gusset overlies one of the side post flanges and an adjacent portion of the side sheet. The upper edges of the gussets, unlike the upper edge of the side sheet and unlike the upper edge of each side post, abuts the inside or bottom surface of the horizontal portion of the adjacent bulb angle top chord.

The in-board leg of the bulb angle top chord is affixed to the side sheet near its upper edge by a plurality of fasteners. At the position of each side post, a pair of these fasteners also pass through the side post flanges. This same pair of fasteners, together with the next adjacent fasteners, also pass through the gussets and, as a result, are placed in double shear. This greatly strengthens the attachment of the top chord. Additional fasteners pass through lower portions of the gussets, the adjacent side post flanges and the side sheet, being in single shear.

As will be described hereinafter, the gussets may be widened or lengthed, or both, to incorporate more fasteners.

In a second embodiment of the invention, a plate may be located on the inside surface of the side sheet in abutment with the in-board leg of the top chord. Those fasteners passing through the lower portions of the gussets, the side post flanges and the side sheet, also pass through this plate to be additionally placed in double shear.

In a third embodiment of the present invention, a longitudinally extending plate is located along the inside surface of the side sheet and overlapping the lower portion of the in-board leg of the top chord. Those rivets passing through the upper portions of the gussets, the side post flanges, the side sheet and the in-board leg of the bulb angle top chord, also pass through this plate to be put in multiple shear. Those fasteners at the lower end of the gussets passing therethrough and through the side post flanges and side sheet, also pass through this plate to be put in double shear.

DETAILED DESCRIPTION OF THE INVENTION

Figures 1, 2, 3:
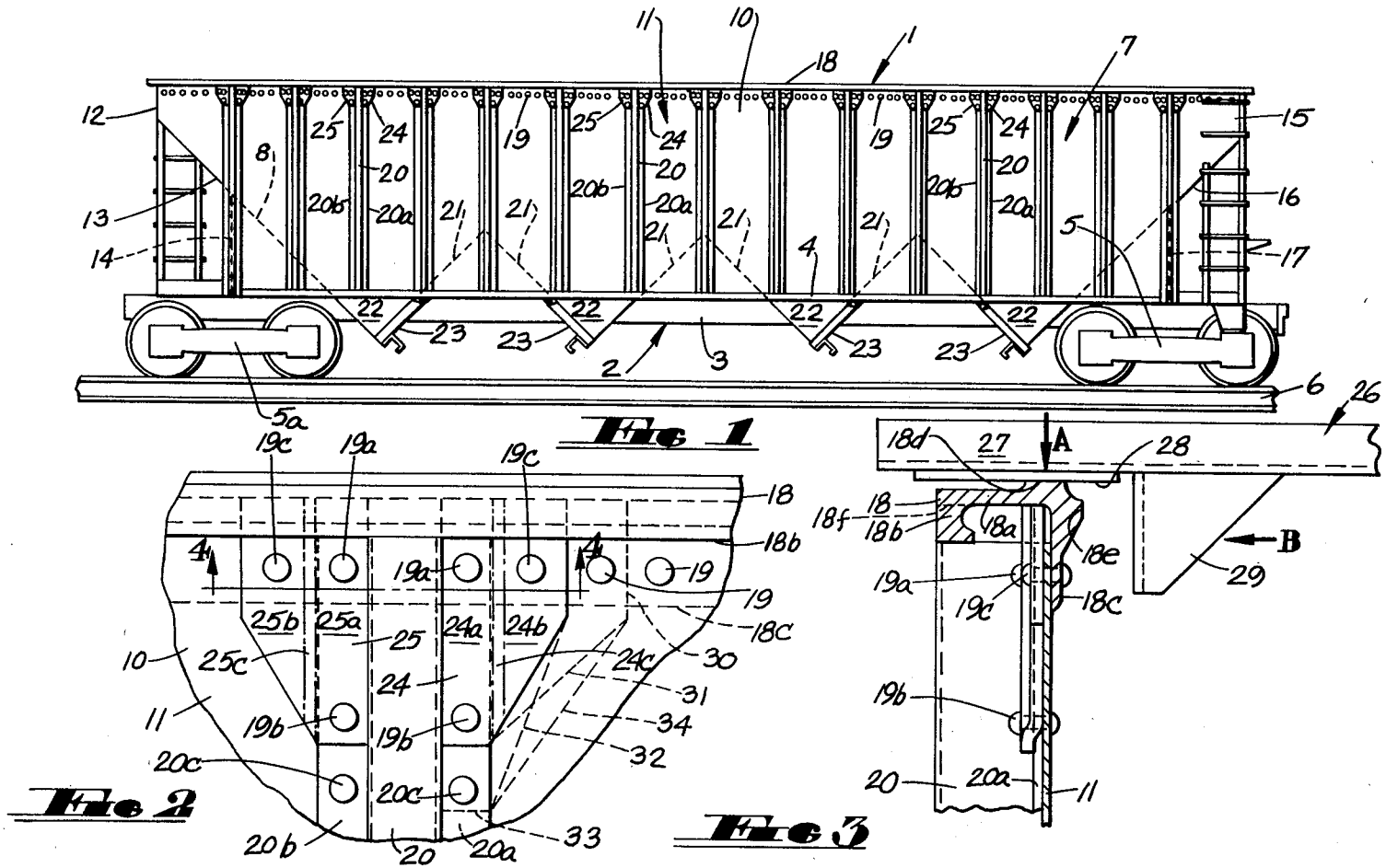
FIG. 1 is a simplified side elevational view of a hopper car provided with the top side chord attachment of the present invention.
FIG. 2 is a fragmentary enlarged elevational view of the top side chord and its attachment at the position of a typical side post.
FIG. 3 is a fragmentary side elevational view, partly in cross section, of the structure of FIG. 2.

Reference is first made to FIG. 1 which illustrates in simplified form an exemplary hopper car to which the present invention is applicable. The hopper car is generally indicated at 1 and comprises an underframe generally indicated at 2. The underframe, itself, comprises a center sill 3 extending substantially the length of the car, flanked by longitudinal side sills, one of which is shown at 4. The side sills are located to either side of center sill 3 and extend substantially the length of the car in parallel spaced relationship to the center sill 3.

Side sill 4 and its counterpart (not shown) are connected to center sill 3 by end sills, bolsters and a plurality of transversely extending braces, all of which are not shown, but are conventional and well known in the art. The underframe 2 is mounted on a pair of conventional trucks 5 and 5*a*. The wheels of trucks 5 and 5*a* are mounted on conventional railroad rails, one of which is shown at 6.

Underframe 2 is made of steel and supports the car body generally indicated at 7. The car body 7 may also be made of steel, or it may be made substantially entirely of aluminum. The car body comprises a pair of sloping end sheets 8 and 9, and a pair of longitudinal sides, one of which is shown in FIG. 1 at 10. The side 10 comprises a side sheet 11. The left end of side sheet 11, as viewed in FIG. 1, terminates in a vertical edge 12, a downwardly and inwardly sloping edge 13 and another vertical edge 14 extending to side sill 4. In similar fashion, the right end of side sheet 11, as viewed in FIG. 1, terminates in a vertical edge 15, a downwardly and inwardly sloping edge 16 and another vertical edge 17, extending to side sill 4. The side sheet 11 may be a single metallic member, or it may be made up of a plurality of individual panels. The side sheet 11 is affixed by appropriate fastening means (not shown) along its lower edge to side sill 4. As used herein and in the claims, the term "fastening means" is inclusive of, but not limited to, such fastening means as rivets, two-piece rivets, bolts and the like.

The upper edge of side sheet 11 is affixed to the top chord 18 of side 10 by a plurality of fasteners 19. As is most clearly shown in FIG. 3, the top chord 18 is illustrated, for purposes of an exemplary showing, in the form of a bulb angle to be further described hereinafter.

To complete side 10, a plurality of substantially identical side posts 20 are provided, arranged vertically in parallel spaced relationship along side 10. As is most clearly shown in FIG. 4, each side post 20 is of hat-shaped cross section, having lateral flanges 20*a* and 20*b* along its length. The side posts 20 are affixed at their lower ends to the bottom chord (side sill 4) of side 10 and at their upper ends to the top bulb angle chord 18 of side 10. The side posts are additionally affixed by fastening means (not shown) throughout their length to side sheet 11, the last mentioned fastening means extending through side post flanges 20*a* and 20*b* and through the side sheet 11. It is within the scope of the invention that side sheet 11 can be affixed to side sill 4 by welding or the like. Similarly, side posts 20 can be affixed to side sill 4 and side sheet 11 (except near their upper ends) by welding or the like.

Hopper car 1 is provided with a plurality of transversely extending interior slope sheets 21. The sloped sheets 21, together with end sheets 8 and 9, form a Plurality of chutes 22, each closed by a hopper door 23. It will be evident from FIG. 1 that chutes 22 and hopper doors 23 lie to one side of center sill 3. It will be understood that an identical series of chutes and hopper doors (not shown) will be located on the other side of center sill 3.

Reference is now made to FIG. 3 wherein the cross-sectional configuration of bulb angle top chord 18 is most clearly shown. The top chord 18 comprises a beamlike structure having a central horizontal portion 18*a* terminating at its out-board longitudinal edge in a downwardly depending, bulb-like leg 18*b* which may abut the upper end of each side post 20, as shown in FIGS. 1 and 3. The lower end of bulb-like leg 18*b* may be spaced upwardly from the upper end of each side post 20, if desired. At its in-board longitudinal edge, the central horizontal portion 18*a* terminates in a downwardly depending leg 18*c* which lies along the inside surface of the upper edge of side sheet 11. It will be noted from FIG. 3 that the upper edge of side sheet 11 is coextensive with the upper edge of side post 20 and is spaced downwardly from the inside surface of the horizontal portion 18*a* of bulb angle top chord 18. The top chord 18 could be of simple angle iron cross-sectional configuration, if desired. In such an instance, the bulb-like out-board leg would not be present. This is indicated by broken line 18*f* of FIG. 3.

As is most clearly shown in FIG. 2, a pair of gussets 24 and 25 are associated with the upper end of side post 20. As is apparent from FIG. 1, each side post 20 is provided with an identical pair of gussets 24 and 25. Gussets 24 and 25 are identical, with the exception that they are mirror images of each other.

Figure 4:
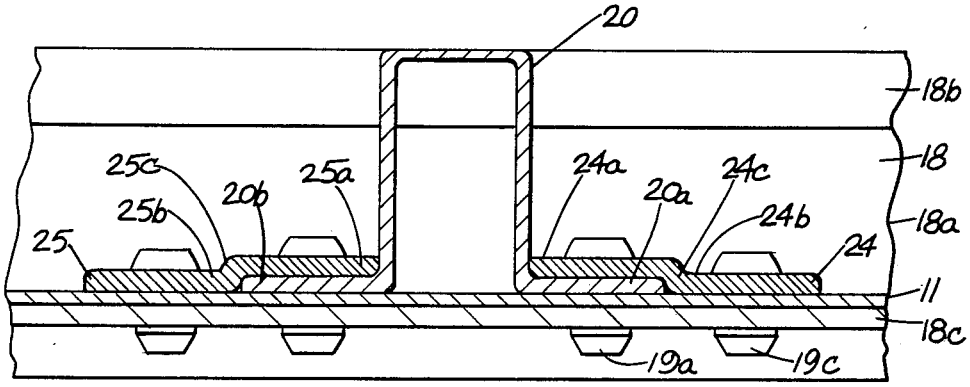
FIG. 4 is a fragmentary cross-sectional view taken along section line 4—4 of FIG. 2.

As is most evident from FIG. 4, gusset 24 has a first portion 24*a* and a second portion 24*b* with a transition portion 24*c* therebetween. While the portions 24*a* and 24*b* are parallel, they are not coplanar. That is, the portions 24*a* and 24*b* are offset with respect to each other by virtue of transition portion 24*c*. This, as is evident from FIG. 4, enables the portion 24*a* to overlie flange 20*a* of side post 20, while the portion 24*b* overlies the adjacent portion of side sheet 11. The same is true of gusset 25, having portion 25*a* overlying the lateral flange 20*b* of side post 20, portion 25*b* overlying the adjacent portion of side sheet 11 and transition portion 25*c* therebetween.

It will be apparent from FIGS. 2 and 3 that gussets 24 and 25 are so arranged that their upper edges abut the inside surface of the horizontal portion 18*a* of bulb angle top chord 18. Portion 24*a* of gusset 24 is shown in FIGS. 2, 3 and 4 as having a fastener 19*a* and a fastener 19*b* in the form of rivets. The fastener 19*a* passes through gusset portion 24*a*, the flange 20*a* of side post 20, side sheet 11 and the leg 18*c* of bulb angle top chord 18. Rivet 19*b* passes through gusset portion 24*a*, side post flange 20*a* and side sheet 11. Gusset portion 24*b* is shown having a fastener in the form of a rivet 19*c*. This rivet passes through gusset portion 24*b*, side sheet 11 and the leg 18*c* of bulb angle top chord 18.

Reference is now made to FIG. 3 wherein one end of a typical car shaker is fragmentarily shown. As indicated above, the shaker, generally indicated at 26, comprises a frame-like body 27 carrying a contact plate 28. A stop member 29 depends downwardly from body 27. The contact plate 28 is adapted to contact the upper surface of bulb angle top chord 18. The bulb angle top chord 18 may have a raised portion 18*d* (integral therewith, or fastened thereto by welding or the like) adapted to be contacted by shaker plate 28. This construction tends to concentrate the predominantly downward force, imparted by the shaker 26 and indicated by arrow A, over the gussets 24 and 25 and side sheet 11.

The stop 29 of shaker 26 is intended to abut the bulb angle top chord 18 should the shaker 26 "walk" in the direction of arrow B. To this end, the bulb angle top chord 18 may have an extension 18*e* (integral therewith or attached thereto by welding or the like) to be abutted by shaker stop 29. The extension 18*e* protects rivets 19, 19*a* and 19*c* from being damaged by shaker stop 29. It will be understood that the other end of shaker 26 will be similarly configured, as will be the bulb angle top chord of the other side (not shown) of hopper car 1.

From the description thus far, it will be apparent that as the preponderance of force from shaker 26 is exerted on bulb angle top chord 18 in the direction of arrow A, rivet 19*a* will be placed in double shear at the interface of gusset portion 24*a* and side post flange 20*a* and at the interface of bulb angle top chord leg 18*c* and side sheet 11 (see FIG. 4). Rivet 19*c* will similarly be placed in double shear at the interface of gusset portion 24*b* and side sheet 11 and at the interface of side sheet 11 and leg 18*c* of bulb angle top chord 18. Rivet 19*b*, passing through gusset portion 24*a*, side post flange 20*a* and side sheet 11 will be in single shear at the interface of gusset portion 24*a* and side post flange 20*a*. When rivets 19*a* and 19*c* are placed in double shear, they are each equivalent to two rivets placed in single shear. It will be understood that gusset 25 will operate in the same manner as gusset 24. Therefore, the rivets passing through gusset 25 will be equivalent to the rivets passing through gusset 24 and have, therefore, been given similar index numerals.

As a result of the above described construction, four rivets (i.e., rivets 19*a* and 19*c* of gusset 24 and rivets 19*a* and 19*c* of gusset 25) have been placed in double shear. Therefore, these last mentioned rivets are equivalent to eight rivets in single shear and are located in a very confined space, together with lower rivets 19*b* in single shear. In this manner, the attachment of the top side chord is greatly strengthened against the high vertical shear loads imposed by shaker 26.

Returning to FIG. 2, the shape of gusset 24 can be modified. For example, the area of gusset portion 24*b* could be increased to the right, as viewed in FIG. 2. This is indicated by broken lines 30 and 31. Under these circumstances, the next adjacent rivet 19 along the top edge of side sheet 11 passes through the gusset and is placed in double shear, just as rivet 19*c*. Alternatively, the gusset 24 could be extended downwardly as indicated by broken lines 32 and 33. As a result of this, one of the fasteners or rivets 20*c* by which side post 20 is affixed to side sheet 11 passes through gusset portion 24*a*. This rivet will be in single shear, as is rivet 19*b*.

Finally, the gusset 24 could be increased both to the right and downwardly, as viewed in FIG. 2. This is indicated by broken lines 30, 33 and 34. As a result of this, rivet 20*c* will pass through gusset portion 24*a* and be in single shear, while the rivet 19 adjacent rivet 19*c* will pass through gusset portion 24*b* and will be in double shear. It will be understood that any of these shape modifications could be made in gusset 25, as well.

Figure 5:
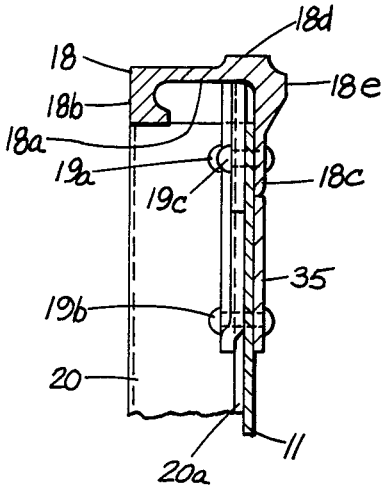
FIG. 5 is a fragmentary elevational view, partly in cross section, similar to FIG. 3 and illustrating a second embodiment of the present invention.

FIG. 5 illustrates a second embodiment of the present invention. FIG. 5 is similar to FIG. 3, and like parts have been given like index numerals. FIG. 5 differs from FIG. 3 only in that an elongated plate 35 is mounted on the inside surface of side sheet 11 below the leg 18*c* of bulb angle top chord 18. The plate 35 extends substantially the length of side sheet 11. In the alternative, plate 35 could represent one of a plurality of short plates, each having a length equivalent to one pair of gussets and each aligned with one pair of gussets. It will be noted that the upper edge of plate 35 is in abutment with the lower edge of bulb angle top chord leg 18*c*. It will further be noted that rivet 19*b* also passes through plate 35. Since the upper edge of plate 35 is in abutment with the lower edge of the leg 18*c* of bulb angle top chord 18, plate 35 acts as an extension of leg 18*c*. As a result of this, rivet 19*b* of gusset 24 (and rivet 19*b* of gusset 25) passing through plate 35, will be put in double shear. The double shear with respect to rivet 19*b* of gusset 24 occurs at the interface of gusset portion 24*a* and side post flange 20*a* and at the interface between plate 35 and side sheet 11. The double shear of rivet 19*b* of gusset plate 25 will occur at corresponding places.

Figure 6:
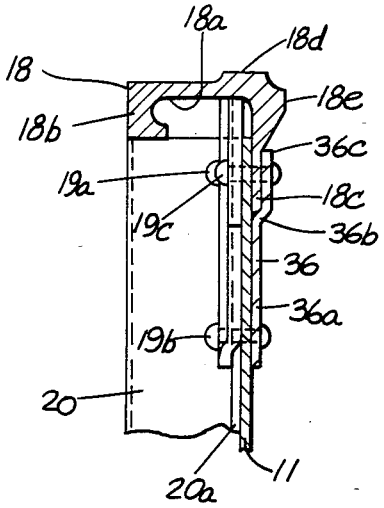
FIG. 6 is a fragmentary side elevational view, partly in cross-section, similar to FIG. 3 and illustrating a third embodiment of the present invention.

FIG. 6 illustrates a third embodiment of the present invention. Again, FIG. 6 is similar to FIG. 3 and like parts have been given like index numerals. FIG. 6 differs from FIG. 3 in that a plate 36, somewhat similar to plate 35 of FIG. 5, is located at the inside surface of side sheet 11 and extends the length of the side sheet. Alternatively, plate 36 could represent a plurality of short, individual plates as decribed with respect to plate 35. In this instance, however, the plate 36 has a first portion 36*a* lying along the inside surface of side sheet 11, a transition portion 36*b* and a third portion 36*c* lying along the leg 18*c* of bulb angle top chord 18. As a result of this, the rivets 19*a* and 19*c* of gusset 24 will pass through the plate portion 36*c*, while the rivet 19*b* of gusset plate 24 will pass through the plate portion 36*a*.

If transition portion 36*b* is so configured that there is a solid abutment between the transition portion 36*b* and the lower edge of leg 18*c* of bulb angle top chord 18, the plate 36 will serve as an extension of leg 18*c* and rivet 19*b* will be placed in double shear, the second shear occurring at the interface of plate portion 36*a* and side sheet 11. If the lower edge of bulb angle top chord leg 18*c* does not contact transition portion 36*b* of plate 36, rivet 19*b* will still be placed in double shear as previously described, and rivets 19*a* and 19*c* will be placed in additional shear at the interface of bulb angle top chord leg 18*c* and plate portion 36*c*. It will be understood that the same considerations will be true with respect to the rivets 19*a*, 19*b* and 19*c* associated with gusset 25.

In both embodiments of FIGS. 5 and 6, the lower rivet 19*b* of gusset portion 24*a* and gusset portion 25*a* are placed in double shear, increasing the number of rivets in double shear and the ability of the top side chord to withstand the high vertical shear loads imparted by the shaker. In both embodiments of FIGS. 5 and 6, the top chords are illustrated as being bulb angles. The top chords could be of simple angle iron cross-sectional configuration, if desired, as described with respect to FIG. 3.

Modifications may be made in the invention without departing from the spirit of it.

What is claimed is:

1. Top side chord attachment for an open-top, bottom-discharge railroad car of the type having sides each comprising a longitudinally extending vertically oriented side sheet with upper and lower edges, a bottom chord, a top chord and a plurality of side posts, said side sheet being affixed at its lower edge to said bottom chord and at its upper edge by fasteners to said top chord, each of said side posts having upper and lower ends and longitudinally extending lateral flanges to either side thereof, said side posts being arranged vertically along the exterior of said side sheet in parallel spaced relationship, each of said side posts being affixed at its lower end to said bottom chord, along said lateral flanges to said side sheet, and at its upper end by fasteners to said side sheet and said top chord, said top chord comprising a beam-like member extending substantially the length of said side sheet and having a horizontal portion terminating at its longitudinal in-board edge in a downwardly depending in-board leg lying along the inside surface of said upper edge of said side sheet, a pair of mirror image gussets located to either side of each side post at said upper end thereof, the upper edge of said side sheet and the upper ends of said side posts being spaced from said horizontal portion of said top chord, said gussets having upper edges abutting said horizontal portion of said top chord, each gusset of each side post having a first portion overlying the adjacent one of said side post flanges and a second portion overlying the adjacent portion of said side sheet, said first gusset portion having an upper fastener passing therethrough and through said adjacent side post flange, said side sheet and said in-board top chord leg in double shear and at least one lower fastener below said upper fastener passing through said first gusset portion, said adjacent side post flange and said side sheet in single shear, said second gusset portion having at least one upper fastener passing therethrough and through said side sheet and said in-board top chord leg in double shear whereby to strengthen said top side chord assembly.

2. The structure claimed in claim 1, wherein said fasteners are chosen from the class consisting of one-piece rivets, two-piece rivets and bolts.

3. The structure claimed in claim 1, wherein said side sheet, said top chord, said side posts, and said gussets are made of steel.

4. The structure claimed in claim 1, wherein said side sheet, said top chord, said side posts and said gussets are made of aluminum.

5. The structure claimed in claim 1, including an elongated plate lying along said inside surface of said side sheet and extending substantially the length thereof, said plate having an upper edge in abutment with the lower edge of said in-board top chord leg, said at least one lower fastener of said gusset first portion passing through said plate and being in double shear.

6. The structure claimed in claim 5, wherein said fasteners are chosen from the class consisting of one-piece rivets, two-piece rivets and bolts.

7. The structure claimed in claim 5, wherein said side sheet, said top chord, said side posts, said gussets and said plate are made of steel.

8. The structure claimed in claim 5, wherein said side sheet, said top chord, said side posts, said gussets and said plate are made of aluminum.

9. The structure claimed in claim 1, including an elongated plate extending substantially the length of said side sheet and having a lower portion lying along the inside surface of said side sheet and an upper portion overlying said in-board top chord leg, said upper fastener of said first gusset portion and said at least one upper fastener of said second gusset portion passing through said upper plate portion and being in multiple shear, said at least one lower fastener of said first gusset portion passing through said lower plate portion and being in double shear.

10. The structure claimed in claim 9, wherein said fasteners are chosen from the class consisting of one-piece rivets, two-piece rivets and bolts.

11. The structure claimed in claim 9, wherein said side sheet, said top chord, said side posts, said gussets and said plate are made of steel.

12. The structure claimed in claim 9, wherein said side sheet, said top chord, said side posts, said gussets and said plate are made of aluminum.

13. The structure claimed in claim 1, wherein said top chord comprises a bulb angle, said horizontal portion thereof terminating at its out-board longitudinal edge in a downwardly depending bulb-like out-board leg.

14. The structure claimed in claim 13, wherein said out-board leg of said top chord abuts the upper ends of said side posts.

15. The structure claimed in claim 1, including a plurality of plates aligned longitudinally along said inside surface of said side sheet, each plate being aligned with the upper end of one of said side posts and the pair of gussets associated therewith, each of said plates having an upper edge in abutment with the lower edge of said in-board top chord leg, said at least one lower fastener of said first portion of each of said gussets of said pair with which said plate is aligned passing through said plate and being in double shear.

16. The structure claimed in claim 15, wherein said fasteners are chosen from the class consisting of one-piece rivets, two-piece rivets and bolts.

17. The structure claimed in claim 15, wherein said side sheet, said top chord, said side posts, said gussets and said plate are made of steel.

18. The structure claimed in claim 15, wherein said side sheet, said top chord, said side posts, said gussets and said plate are made of aluminum.

19. The structure claimed in claim 1, including a plurality of plates aligned longitudinally along said inside surface of said side sheet, each plate being aligned with the upper end of one of said side posts and the pair of gussets associated therewith, each plate having a lower portion lying along the inside surface of said side sheet and an upper portion overlying said in-board top chord leg, said upper fastener of said first gusset portion and said at least one upper fastener of said second gusset portion of each of said gussets with which said plate is aligned passing through said upper plate portion and being in multiple shear, said at least one lower fastener of said first portion of each of said gussets with which said plate is aligned passing through said lower plate portion and being in double shear.

20. The structure claimed in claim 19, wherein said fasteners are chosen from the class consisting of one-piece rivets, two-piece rivets and bolts.

21. The structure claimed in claim 19, wherein said side sheet, said top chord, said side posts, said gussets and said plate are made of steel.

22. The structure claimed in claim 19, wherein said side sheet, said top chord, said side posts, said gussets and said plate are made of aluminum.

* * * * *